US006722526B1

(12) United States Patent
Passetti

(10) Patent No.: US 6,722,526 B1
(45) Date of Patent: Apr. 20, 2004

(54) COOKIE/CRACKER DISPENSER

(76) Inventor: Valentino Passetti, 923 Hotel Ave., Hayword, CA (US) 94541

( * ) Notice: Subject to any disclaimer, the term of this patent is extended or adjusted under 35 U.S.C. 154(b) by 91 days.

(21) Appl. No.: 10/051,658

(22) Filed: Jan. 22, 2002

(51) Int. Cl.[7] ..... A47F 1/04

(52) U.S. Cl. ..... 221/155; 221/281; 221/283; 221/309

(58) Field of Search ..... 221/155, 281, 221/303, 283, 282, 309, 312 R, 312 C; 312/42; 211/59.2

(56) References Cited

U.S. PATENT DOCUMENTS 1,371,331 A * 3/1921 Swift
1,576,010 A 3/1926 Swartz
1,673,812 A * 6/1928 Dunn
1,973,867 A 9/1934 Cook
2,148,382 A 2/1939 Stevens
2,226,626 A 12/1940 Mann
2,247,834 A 7/1941 Davis
2,295,313 A * 9/1942 Weir
2,868,414 A 1/1959 Pryor
2,902,187 A * 9/1959 Cabanban
3,164,298 A * 1/1965 Repko
3,263,860 A 8/1966 Haas
3,287,073 A * 11/1966 Holtkamp
3,298,568 A 1/1967 Brocq
3,471,056 A 10/1969 Kovac
3,833,148 A 9/1974 Honas
4,132,329 A * 1/1979 Harrison ..... 221/45
4,170,325 A 10/1979 Pawlowski
4,491,242 A * 1/1985 Trinidad ..... 221/312 R
5,957,325 A * 9/1999 Montanez ..... 221/131
6,390,337 B1 * 5/2002 Shea ..... 222/181.2

* cited by examiner

*Primary Examiner*—David H. Bollinger
(74) *Attorney, Agent, or Firm*—Harris Zimmerman

(57) ABSTRACT

A cracker dispenser for dispensing individual crackers in a sanitary manner such as at public cooking events and at wine and cheese tasting events. The cracker dispenser includes a plastic housing for receiving a plurality of stacked crackers from a standard size roll of crackers. The housing is of elongate rectangular shape with a horizontal lower wall of a rectangular shape slightly larger than the individual crackers. Three upstanding walls include a rear wall and opposing side walls which extend from the lower wall to retain the plurality of crackers into a cracker receiving interior chamber defined by the housing in a stacked position. A movable door in the form of a sliding door or a latching hinged door is connected to the housing to selectively cover a cracker roll receiving opening formed at the front of the housing between the two side walls to admit crackers from the roll thereof and closing to cover the cracker roll receiving opening. A finger receiving slot through the lower wall extends forwardly from adjacent the rear wall to a cracker dispensing opening formed between a lower edge of the movable door and the lower wall. The housing mounts to a vertical surface using a pair of mounting holes or hangs using a wire hanger. A lowermost cracker may be removed from the inner chamber by engaging the lowermost cracker by finger and sliding outwardly from said interior chamber. A next lowermost cracker then becomes the lowermost cracker for subsequent removal.

15 Claims, 2 Drawing Sheets

COOKIE/CRACKER DISPENSER

BACKGROUND OF THE INVENTION

1. Field

Figure 2:
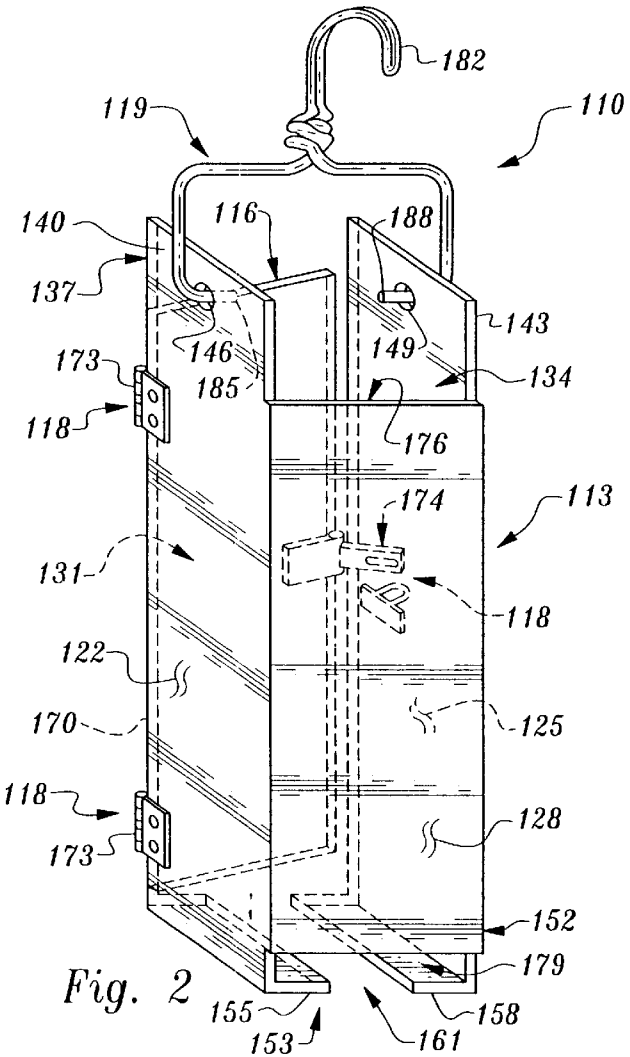

The present invention relates to receptacles or dispensers for individually dispensing small flat items and more particularly to dispensers for dispensing crackers.

2. State of the Art

Crackers are a widely enjoyed food item which are often eaten with various cheeses and spreads. The crackers, which can be rectangular, round, oblong, or other such shape, are typically packaged together in a stacked configuration and heat sealed within a thin plastic wrapper to form cracker rolls which are packed together in cardboard boxes. The consumer subsequently opens the cardboard box and removes a single cracker roll, which is opened to expose a plurality of the crackers for use directly from therefrom, or for placement on a cracker tray surrounding a bowl containing a spread for use on the crackers. This exposure of the crackers to handling by multiple persons, possible coughing and sneezing, and other forms of contamination is usually acceptable to small groups of people whom know each other such as at social occasions. However, this exposure is generally not acceptable for public gatherings wherein people are present whom are strangers to each other and wherein state and federal laws may govern sanitation. Various types of public gatherings wherein crackers might be used include seminars wherein food is prepared with subsequent tasting of the prepared foods, and wine and cheese tasting events. Crackers are necessary for these types of gatherings for tasting of some types of foods such as for applying spreads, cheeses, and for "cleansing the pallette" between tasting of various wines. At such public gatherings, open cracker rolls or open stacks of crackers are undesirable since the crackers can be handled by multiple persons.

Various dispensing devices have been developed particularly designed for dispensing crackers. For example, in U.S. Pat. No. 2,148,382 issued to Stevens is disclosed a sanitary receptacle for crackers which rests on a flat horizontal surface such as a table top. The receptacle includes a curved body having an arcuate bottom and sides. the highest point of the bottom being at the center of the receptacle. Two ends of the body extend upwardly at an angle off vertical from respective upwardly curved portions of the bottom wall bottom. Respective upper corners of the sides are provided with cut-out portions to expose the upper side edges of several of the crackers when placed within the body. A top lid fits to arcuate upper edges of the sides and includes a pair of grooves which fit over the edges of the sides to mate with the body. A knob is provided for grasping the lid. Crackers placed within the body are gravity fed toward one of the ends of the body, with the leading cracker at each end being forced by the weight of the subsequent crackers to follow the curvature of the bottom and slightly elevate the leading cracker. This allows a person to grasp a cracker more easily from the receptacle.

In U.S. Pat. No. 2,226,626 issued to Mann is disclosed a cracker dispenser for dispensing up to four crackers simultaneously. The dispenser comprises a casing having four sheet metal corner posts of right-angle cross-section which are held in a rectangular spaced apart relationship at respective upper ends thereof by a band and at respective lower ends thereof by a square wooden bottom. The four corner posts extend below the wooden bottom to provide legs for supporting the dispenser. The casing is divided into four vertically disposed cracker receiving compartments which extend the length of the casing using a pair of metal partitions. A pair of metal guide strips are disposed in each respective lower portion of the vertical compartments with upper ends thereof secured to the partitions. The guide strips are curved, being slanted downward and outwardly to respective forward and rear edges of the bottom. A pair of glass side plates extend from the top of the casing, with a pair of front and rear glass plates which terminate just short of the bottom to leave openings for removing crackers from the casing. A removable top lid fits over the casing to form an enclosed container for the crackers. A weight is suspended by a spring from the lid at the center of each compartment resting on stacks of crackers disposed in the respective compartments. The weight forces the crackers downwardly such that when inner edges of the crackers contact the curved guide strips and outer edges of the cracker reach the openings, the crackers are caused to slant downward and are impelled outwardly of the casing whereby they may be grasped in hand using one's fingers. The dispenser is for keeping the crackers fresh, clean and sanitary with the crackers therein visible through the glass sides and ends.

In U.S. Pat. No. 2,247,834 issued to Davis, Jr. et al. is disclosed a cracker dispenser which comprises a casing of rectangular cross-section with an open top. A top lid is frictionally engagable a with the casing to close the open top thereof. The casing includes a plurality of openings which extend through the bottom of the casing for removing crackers. A base is attached to the bottom of the casing which is hollow, open at the bottom, and of a frusto-pyramidal shape. The casing is subdivided into a pair of individual cracker storage compartments by an integrally formed, slotted dual upright partition and cracker supporting platform made of a single sheet of material. The partitions diverge slightly from top to bottom with the cracker supporting platforms being in a common plane. A pair of slotted ejector grids are each of a rectangular shape being made of a sheet of material. A pair of upright lugs are formed on a rear edge of each ejector grid and a handle is formed on a front edge of each ejector grid. The ejector grids are slidably mounted beneath the cracker supporting platforms whereby respective slots of the cracker supporting platforms are disposed in registry with the upright lugs of the ejector grids. Therefore, the upright lugs can ride in the slots of the respective cracker supporting platform during sliding motion of the ejector grids, the handles facilitating gripping of the ejector grids. A hook is mounted on each of the ejector grids which is connected to a common spring therebetween for holding the grids in a retracted position within the casing. When crackers are stacked within the two compartments of the casing, the crackers rest against the partition elements and upon the cracker supporting platforms. Individual crackers are ejected from the respective compartment by gripping in hand and pulling horizontally outwardly on the handle of one or both ejector grids. As the ejector grid slides outwardly, the upright lugs engage with a back portion of the lowermost cracker from the stack whereby the cracker is moved outwardly through the ejector port. Upon release of the handle the grid moves back to a retracted position under the bias of the spring with an outwardly projecting portion of the cracker being held in place between the stack of crackrs and the cracker supporting platform. The cracker may then be grasped in hand and pulled from the dispenser.

Dispensers for individually dispensing items other than crackers have also been developed. For example, in U.S. Pat. No. 1,576,010 issued to Swartz is disclosed a package dispensing container having a body in the form of an upright chute made of sheet metal. The chute includes a back, a pair of sides, and a pair of front flanges disposed in a spaced relationship to define a central upright opening. The upright opening is covered by a strip of transparent glass wherein respective side edge portions of the glass are slidably held by respective folded edge portions of the front flanges with a bottom edge of the glass engaging respective inwardly bent lips of a lower portion of the respective folded edge portions to provide a stop for the bottom edge of the glass short of the bottoms of the sides and the back to provide an open mouth. A pair of forwardly projecting arms extend from a bottom portion of the back, each arm being horizontal with downwardly angled forward end portions. A central deflecting tongue also extends from the bottom portion of the back between the arms, being split upward from its bottom and bowed forwardly, a forward portion of the tongue extending downwardly though a space between the arms, forward of the plane of the back. The top of the chute is inclined and provided with yoked cover to cover the open upper end of the chute. The cover can be opened forward to an approximately horizontal position abutting the forward portion of the chute such that the chute can be refilled with packages to be dispensed, and the portion of the cover when in the swung position serves as a shelf for temporarily supporting the packages to permit the use of both hands to insert the packages into the chute through the open top. Once filled, the weight of the stacked packages in the chute causes the rear lower edge of the lowermost package to engage the tongue at a position adjacent the back such that the weight causes the lowermost package to be projected forwardly until it rests upon and is supported only by the arms with the front thereof projecting through the mouth in a position where it can be grasped in hand and removed from the dispenser. The process continues as more packages are removed sequentially from the dispenser, those packages above fall due to the weight of the stacked packages, the lowermost package is projected forwardly by the tongue.

In U.S. Pat. No. 4,170,325 issued to Pawlowski et al. is disclosed a dispensing carton for flat, rectangular items. Comprising a carton of generally rectangular cross-sectional shape which includes a pair of compartments each of generally rectangular cross-sectional shape and defined by elongate side walls in combination with the end walls. A stack of rectangular items such as paper pouches containing tea bags are stacked in each compartment of the carton. The cross-sectional area of the compartments is less than that of the item, with one dimension thereof being about the same as the corresponding dimension of the item and in one direction, and is less than the corresponding dimension of the item in the other direction. Therefore, the items stack within the compartments at an angle slightly off horizontal. A slot is provided in a lower region of one side wall to remove the items one by one, with central upper and lower edges of the slot being notched to facilitate grasping the items. The lowermost item for dispensing lies horizontally and the adjacent item immediately thereabove lies at an angle off horizontal as do the other items, being retained by the side walls such that lowermost item for dispensing contacts the adjacent item immediately thereabove only at a rear edge of each. This designed permits grasping and removal of lowermost item for dispensing through the slot to cause the adjacent item immediately thereabove to move and pivot downwardly to the lowermost position for removal through the slot. This design assures one-at-a-time dispensing of the items and ease of item removal due to minimal friction between the lowermost item being dispensed and the adjacent item immediately thereabove, with essentially a line contact between the item being dispensed and the adjacent item immediately thereabove.

There is a need for a rack or dispenser in which a stack of crackers may be positioned and sequentially removed one by one from the lower end of the stack, particularly for the food preparation gatherings wherein only a single cracker is typically needed by each person.

SUMMARY OF THE INVENTION

The present invention is a cracker dispenser which includes a housing adapted to receive a plurality of stacked crackers from a roll thereof. The housing has a generally horizontally disposed lower wall with a finger receiving slot and at least one upstanding wall adapted to retain the plurality of crackers in a stacked position. The housing includes a cracker dispensing opening is disposed adjacent the lower wall for slidably dispensing the crackers. The housing has a cracker roll receiving opening for admitting crackers from the roll thereof into a cracker receiving interior chamber defined by the housing. The cracker dispenser further includes a movable door operatively connectable to the housing for selectably opening to admit crackers from the roll thereof and closing to cover the cracker roll receiving opening. A lowermost cracker may be removed from the inner chamber by engaging the lowermost cracker by finger and sliding outwardly from said interior chamber. A next lowermost cracker then becomes the lowermost cracker for subsequent removal. It should be noted at the outset that the word "cracker" or "crackers" as used herein is intended to cover other edible items such as cookies and other generally flat food products.

THE DRAWINGS

Figure 1:
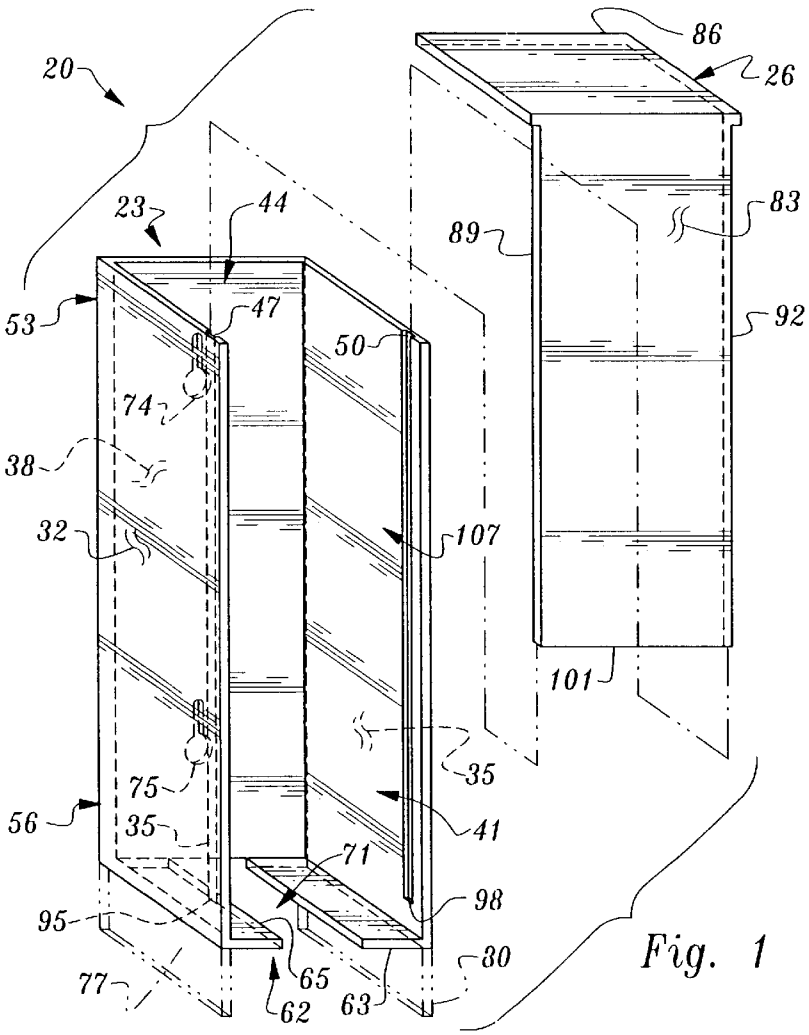
Figure 3:
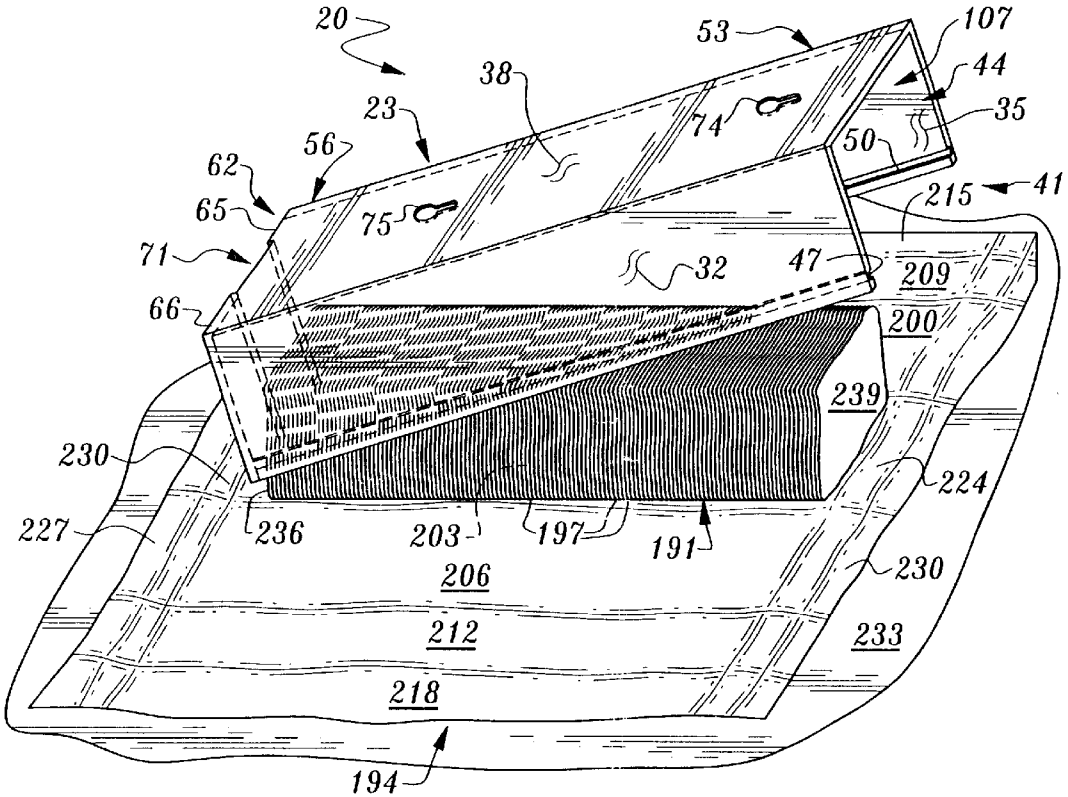
Figure 4:
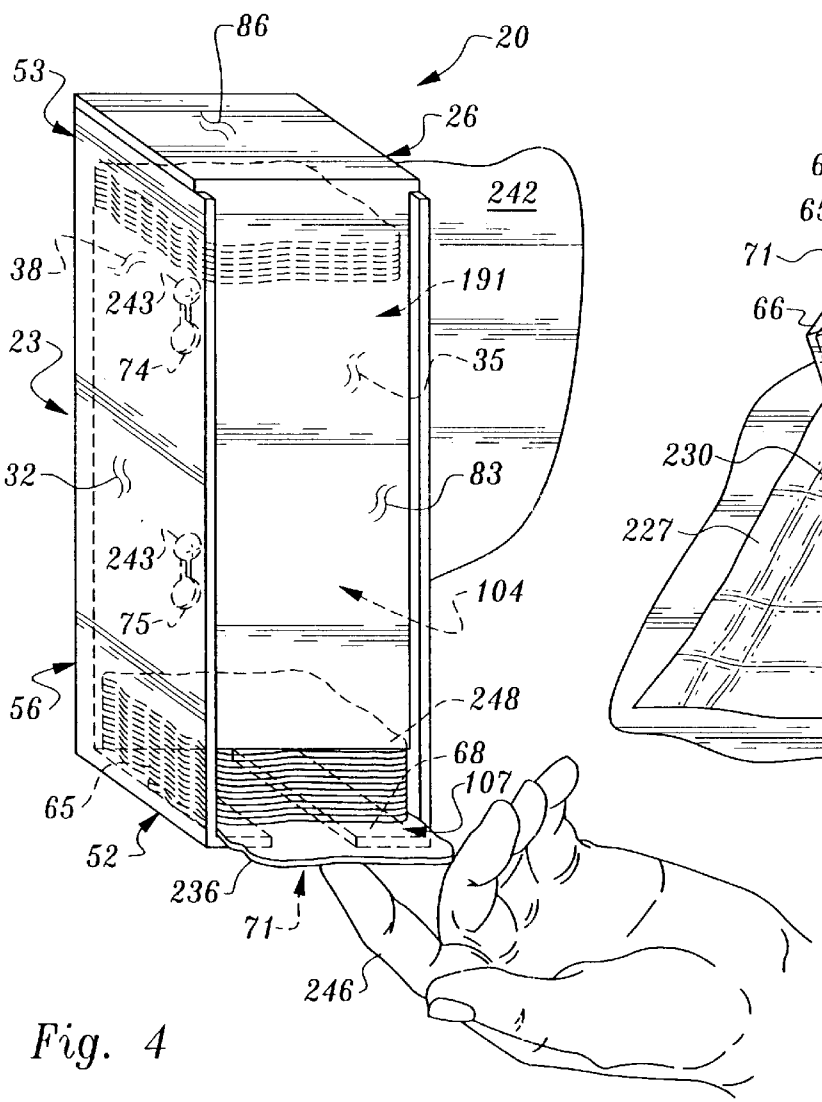

The best mode presently contemplated for carrying out the invention is illustrated in the accompanying drawings, in which:

FIG. 1 is an exploded perspective view of an exemplary first embodiment cracker dispenser in accordance with the present invention which utilizes a sliding door;

FIG. 2, a perspective view of an exemplary second embodiment cracker dispenser in accordance with the present invention which utilizes a hinged door;

FIG. 3, a perspective view of the first embodiment cracker dispenser with the sliding door removed loading a full roll of crackers; and FIG. 4, a perspective view of the first embodiment cracker dispenser as filled with a roll of crackers and the sliding door reinstalled, showing the removal of a cracker by hand.

DETAILED DESCRIPTION OF THE ILLUSTRATED EMBODIMENTS

Referring to FIG. 1, a first exemplary embodiment of a cracker dispenser in accordance with the present invention, designated generally at 20, preferably comprises a plastic housing 23 and a mating sliding door 26, both made of a plastic such as polyvinyl chloride, polypropylene, or acrylic, a hinge and latch assembly 118, and a wire hanger 119. The housing and door can also be made of other form-retaining material, including wood, metal, paperboard, or the like. Plastic is generally preferred for its case of cleaning, transparency, and durability. The housing 23 includes a pair of side walls 32 and 35 which are interconnected by an integral rear wall 38, forming a front cracker roll receiving opening 41 and an upper opening 44. A pair of front door receiving slots 47 and 50 extend vertically along the respective side walls 32 and 35 at the cracker roll receiving opening 41 from an upper portion 53 of the housing 23 to a lower portion 56 thereof. The lower portion 56 of the housing 23 ends at a lower end wall 62 comprised of a pair of cracker support tabs 65 and 68 which a project inwardly from the respective side walls 32 and 35 forming a finger receiving slot 71 therebetween. A pair of hanging key holes 74 and 75 extend through the rear wall 38 at the upper portion 53 of the housing 23 for hanging on a vertical surface using a screw (not shown). The lower portion 59 of the housing 23 may include lower extensions of the respective side walls 32 and 35 comprising a pair of leg tabs 77 and 80 (phantom lines) for supporting the cracker dispenser 20 on a flat horizontal surface (not shown). The sliding door 26 includes a front panel 83 and an upper panel 86 at a right angle thereto. Respective side edges 89 and 92 of the front panel 83 slidably engage the slots 47 and 50 of the respective side walls 32 and 35, with respective lower ends 95 and 98 of the slots 47 and 50 which engage a lower edge 101 of the front panel 83 in a closed position of the sliding door 26, with the upper panel 86 of the sliding door 26 closely fitting against the upper portion 53 of the housing 23, defining a cracker receiving interior chamber 104 and a front cracker dispensing opening 107 for outwardly sliding a cracker (not shown).

Referring to FIG. 2, a second exemplary embodiment of a cracker dispenser in accordance with the present invention, designated generally at 110, comprises a plastic housing 113, a mating hinged door 116, both made of a plastic such as polyvinyl chloride, polypropylene, or acrylic, a hinge and latch assembly 118, and a wire hanger 119. The housing 113 includes a pair of side walls 122 and 125 which are interconnected by an integral front wall 128, forming a front cracker roll receiving opening 131 and an upper opening 134. An upper portion 137 of the housing 113 includes upper extensions of the respective side walls 122 and 125 comprising a pair of hanging tabs 140 and 143 having respective holes 146 and 149 therethrough. A lower portion 152 of the housing 113 ends at a lower end wall 153 comprised of a pair of cracker support tabs 155 and 158 which project inwardly from the respective side walls 122 and 125 forming a finger receiving slot 161 therebetween. The hinged door 116 includes a side edge 170 which is hingedly connected to the side wall 122 using a pair of hinges 173 and which can be retained in a closed position using a latch 174 of the hinge and latch assembly 118. With the hinged door 116 in the closed position, a cracker receiving interior chamber 176 and a front cracker dispensing opening 179 for outwardly sliding a cracker (not shown) are defined. The wire hanger 119 includes a main hook 182 and a pair of downwardly dependent, inwardly oriented side hooks 185 and 188 which fit through the holes 146 and 149 of the hanging tabs 140 and 143 to hang the cracker dispenser 110 from a rod (not shown) or other such horizontally disposed member.

Referring to FIG. 3, therein is shown how the cracker dispenser 20 is easily and conveniently loaded with a cracker roll 191. The cracker roll 191 comprises an outer plastic wrapper 194 containing a plurality of individual crackers 197. The crackers 197 are contained within the cracker roll 191 by respective side walls 200, 203, and 206, and respective half top walls 209 and 212 which are heat sealed together at a pair of longitudinal sealing flaps 215 an 218. A pair of half end walls 221 and 224 complete the enclosing which are heat sealed at a pair of end sealing flaps 227 and 230. Thus, the crackers 197 are sealed within the wrapper 194 in a sanitary condition and the objective is to move the crackers from the cracker roll 191 to within the cracker dispenser 20 without contaminating the crackers 197. This is accomplished by opening the wrapper 194 by pulling apart the end sealing flaps 227 and 230 and laying the partially opened cracker roll 191 on a flat sanitary surface such as table top 233 using one's hands to maintain the crackers 197 in the substantially horizontally stacked configuration shown. The longitudinal sealing flaps 215 and 218 are then pulled apart and the wrapper 194 is opened as shown with the crackers 197 resting on the side wall 203. The housing 23 with the sliding door 26 removed therefrom is placed at an angle over the stack crackers 197 with the cracker roll receiving opening 41 downwardly disposed over the stack of crackers 197 and the cracker support tabs 65 and 68 supporting a first endmost cracker 236 and one's fingers (not shown) supporting a second endmost cracker 239 to maintain the crackers 197 in the horizontally stacked position shown. With the housing 23 completely disposed over the crackers 197 and the first and second endmost crackers and 236 and 239 supported as described above, the side walls 200 and 206 are then wrapped upwardly around the respective sides 32 and 35 of the housing 23 and held using one's other hand (not shown). The housing is then moved to a generally vertical position tipped slightly toward the rear wall 38 with the first endmost cracker 236 supported by the cracker support tabs 65 and 68, the wrapper 194 retaining the crackers 197 within the cracker receiving interior chamber 107. The sliding door 26 is then assembled to the housing 23 to retain he crackers 197 therein. A similar process is used to load crackers 197 into the cracker dispenser 110 from the cracker roll 191 except that the hinged door 116 is opened fully to rest against the side wall 122 of the housing 113 during h loading process, and the side wall 206 of the wrapper 194 is held against the hinged door 116 during upward tilting of the housing 113.

Referring to FIG. 4, the cracker dispenser 20 is shown hung on a vertical surface 242 using a pair of screws 243 through the hanging key holes 74 and 75, and loaded with a plurality of crackers 197. The first endmost cracker 236 is removed from the cracker dispenser 20 by hand using one's index finger 245 which engages the first endmost cracker through the finger receiving slot 71 between the cracker support tabs 65 and 68. Pulling the index finger 245 in a horizontally forward direction while applying a slight upward force to the first endmost cracker 236 causes it to extend through the front cracker dispensing opening 107 for gasping and removing by hand. A next endmost cracker 248 then drops onto the cracker support tabs 65 and 68 due to the weight of the crackers 197 for subsequent removal. During the cracker removal process, only one cracker 197 can be engaged by the index finger 245 due to the relatively narrow width of the finger receiving slot 71 and the low height of the front cracker dispensing opening 107.

Many variations to the cracker dispenser of the present invention are possible while staying within the same inventive concept. For example, while the cracker dispenser is shown as being of generally rectangular horizontal cross-section, a round, oval, or other such cross-section could be used to match the shape of round or oval crackers. The cracker dispenser can be translucent, opaque, part translucent and part opaque, and colored or tinted.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A cracker dispenser, comprising:

a housing adapted to receive a plurality of stacked crackers from a roll thereof, said housing having a generally horizontally disposed lower wall with a finger receiving slot and at least one upstanding wall adapted to retain the plurality of crackers in a stacked position, a cracker dispensing opening disposed adjacent said lower wall for slidably dispensing the crackers, and a cracker roll receiving opening for admitting crackers from the roll thereof into a cracker receiving interior chamber defined by said housing; said cracker roll receiving opening being disposed at one of a front and a rear of said housing;

a movable door operatively connectable to said housing for selectably opening to admit crackers from the roll thereof and closing to cover said cracker roll receiving opening; and wherein a lowermost cracker may be removed from said inner chamber by engaging said lowermost cracker by finger and sliding outwardly from said interior chamber, a next lowermost cracker becoming the lowermost cracker for subsequent removal.

2. The cracker dispenser according to claim 1, wherein the cracker roll receiving opening and the movable door are disposed at the front of the housing.

3. The cracker dispenser according to claim 1, wherein the movable door comprises a sliding door.

4. The cracker dispenser according to claim 1, wherein respective upper and lower borders of the cracker dispensing opening are defined by a lower edge of the moveable door and the lower wall.

5. The cracker dispenser according to claim 1, wherein the movable door comprises a hinged door having a side edge which is hingedly connected to the at least one upstanding wall of the housing, said hinged door being retainable in a closed position using a retaining device.

6. The cracker dispenser according to claim 1, wherein the lower wall is of a generally rectangular configuration and the at least one upstanding wall comprises three generally rectangular walls upwardly dependent from respective edges of said lower wall, and wherein the movable door comprises a sliding door which includes a pair of side edges which slidably engage respective slots of an opposing pair of the side walls, respective lower, ends of said slots which engage a lower edge of said sliding door in a closed position of said sliding door, defining the cracker dispensing opening at a front of said housing for outwardly sliding the lowermost cracker.

7. The cracker dispenser according to claim 6, wherein the sliding door includes a vertically disposed panel and an upper panel at a generally right angle thereto, said vertically disposed panel having the side edges which slidably engage the slots of the side walls of the housing, wherein the sliding door in the closed position said upper panel closely fits against an open upper portion of said housing defining the cracker receiving interior chamber.

8. The cracker dispenser according to claim 6, wherein the opposing pair of the side walls each include a downwardly dependent leg tab to support the cracker dispenser on a horizontally disposed surface.

9. The cracker dispenser according to claim 6, wherein a rearmost of the side walls comprises a rear wall which includes at least one mounting hole for hanging the cracker dispenser on a vertically disposed surface.

10. The cracker dispenser according to claim 9, wherein the at least one mounting hole is key-shaped.

11. The cracker assembly according to claim 1, wherein the lower wall is of a generally rectangular configuration and the at least one upstanding wall comprises three generally rectangular walls upwardly dependent from respective edges of said lower wall;

wherein the movable door comprises a hinged door having a side edge which is hingedly connected to one wall of the housing, said hinged door being retainable in a closed position using a retaining devices; and wherein the hinged door is connected to the housing using a plurality of hinges and the retaining device comprises a retaining latch.

12. The cracker dispenser according to claim 11, wherein at least one of the walls includes an upwardly dependent hanging tab having a hole therethrough from which to hang the cracker dispenser.

13. The cracker dispenser according to claim 11, wherein an opposing pair of walls each include an upwardly dependent hanging tab having respective holes therethrough from which to hang the cracker dispenser.

14. The cracker dispenser according to claim 13, further comprising a hanger having a main hook and a pair of downwardly dependent hooks each adapted for engaging the hole of one hanging tab.

15. The cracker dispenser according to claim 1, wherein the lower wall is of a generally rectangular configuration and the at least one upstanding wall comprises three generally rectangular walls upwardly dependent from respective edges of said lower wall, and wherein the movable door comprises a hinged door having a side edge which is hingedly connected to one wall of the housing, said hinged door being retainable in a closed position using a retaining device, and wherein respective upper and lower borders of the cracker dispensing opening are defined by a lower edge of the hinged door and the lower wall.

* * * * *